US007246638B2

(12) United States Patent
Vial et al.

(10) Patent No.: US 7,246,638 B2
(45) Date of Patent: Jul. 24, 2007

(54) FILLING DEVICE COMPRISING LATERAL FILLING WINDOWS

(75) Inventors: Siegbert Vial, Burgwald (DE); Georg Keil, Gross-Bieberau (DE)

(73) Assignee: Senator GmbH & Co. KGaA, Gross Bieberau (DE)

( * ) Notice: Subject to any disclaimer, the term of this patent is extended or adjusted under 35 U.S.C. 154(b) by 188 days.

(21) Appl. No.: 10/501,322

(22) PCT Filed: Jan. 10, 2003

(86) PCT No.: PCT/DE03/00054

§ 371 (c)(1),
(2), (4) Date: Nov. 15, 2004

(87) PCT Pub. No.: WO03/059646

PCT Pub. Date: Jul. 24, 2003

(65) Prior Publication Data

US 2005/0069374 A1 Mar. 31, 2005

(30) Foreign Application Priority Data

Jan. 15, 2002 (DE) ..... 102 01 318

(51) Int. Cl.
*B65B 1/04* (2006.01)

(52) U.S. Cl. ..... 141/20.5; 401/199

(58) Field of Classification Search ..... 141/2, 141/18, 20.5; 401/136, 198, 199, 196
See application file for complete search history.

(56) References Cited

U.S. PATENT DOCUMENTS

| | | | | |
|---|---|---|---|---|
| 1,551,792 | A * | 9/1925 | Bleier | 401/170 |
| 5,897,265 | A * | 4/1999 | Wilson | 401/199 |
| 6,112,626 | A * | 9/2000 | Risner et al. | 81/468 |
| 6,761,496 | B2 * | 7/2004 | Osada et al. | 401/199 |
| 6,966,717 | B1 * | 11/2005 | Kuo | 401/195 |

FOREIGN PATENT DOCUMENTS

| | | | |
|---|---|---|---|
| DE | 4104871 | * | 8/1992 |

* cited by examiner

*Primary Examiner*—Steven O. Douglas
(74) *Attorney, Agent, or Firm*—Duane Morris LLP

(57) ABSTRACT

A filling device for a writing instrument has a reservoir positioned in a housing (for a refillable liquid. A wick-like section of a writing tip exposed on one end of the housing projects into this reservoir. A filling spout for the liquid is able to be attached to the other end of the housing. A movable dosing cap is provided on the filling spout in order to expose at least one filling opening for supplying the liquid before reaching an end position of the dosing cap.

19 Claims, 3 Drawing Sheets

FILLING DEVICE COMPRISING LATERAL FILLING WINDOWS

BACKGROUND OF THE INVENTION

The present invention relates to a filling device and a method for filling writing instruments, as are available under the name Senator "Aqua-Maler", for example, cf. instructions for Aqua-Maler, commercially available. "Writing" includes all ways of applying a marking to a surface, such as painting, ornamentation, and filling out forms.

A known writing instrument has a reservoir positioned in the housing for the refillable writing material, into which a wick-like part of the writing tip, which is exposed at one end of the housing, projects. The housing is open at the other end for refilling and may be sealed closed by a separate cap.

It is the object of the present invention to significantly simplify the filling, refilling, or replenishing of the writing instrument for the user, in particular accelerate it.

BRIEF DESCRIPTION OF THE DRAWINGS

The present invention will be described in greater detail in the following with reference to schematic figures on the basis of an exemplary embodiment.

FIG. 6 is a section I—I of FIG. 5.

DETAILED DESCRIPTION OF PREFERRED EMBODIMENTS

Figure 1:
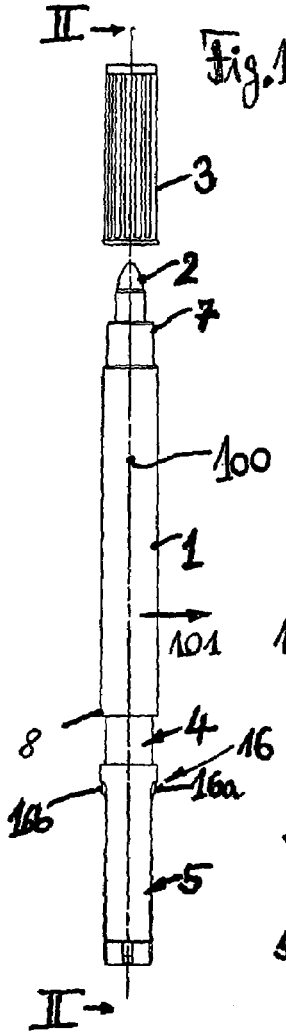
FIG. 1 is a writing instrument or painting instrument having the filling device according to an exemplary embodiment of the present invention in a side view, the instrument and the filling device being in the filling position.
Figure 2:
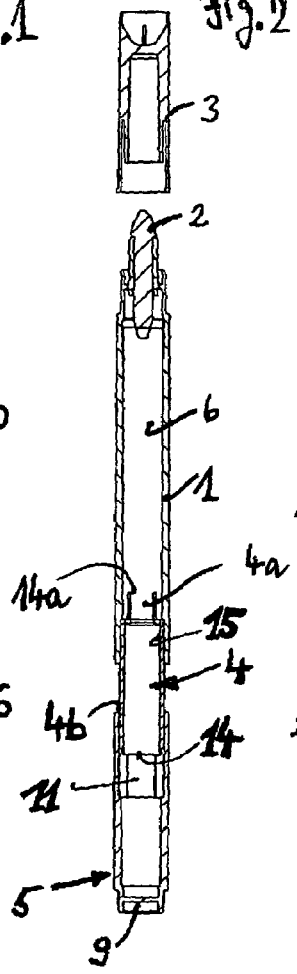
FIG. 2 is an axial section through the instrument shown in FIG. 1 along section line II—II in FIG. 1.

The filling device according to the present invention has a filling spout which is insertable into the housing. A dosing cap is provided, which is tailored to the filling spout and is movable in relation thereto, and which remains on the spout for the filling.

According to the present invention, the filling spout is insertable into the end of the housing to form a seal. The dosing cap is preferably positioned on the filling spout so it is movable in relation thereto but is captive.

Therefore, only a small relative motion between the dosing cap and the filling spout, which is inserted into the housing to form a seal, in order to expose at least one filling opening, via which the liquid may be poured into the filling spout and via this into the reservoir of the housing, is required for (re)filling. In this case, the writing instrument is held with the writing tip upward, both during the refilling and during the displacement of the dosing cap into the closed position in relation to the filling spout, before the instrument is reversed so that the writing tip points downward and the refilled liquid may flow out of the dosing cap (its transitional reservoir) into the reservoir space of the housing.

The housing is also sealed to the outside with the movement of the dosing cap into the closed position, so that liquid may no longer reach the outside, unless it is as colored writing material via the writing tip itself.

The filling procedure is thus significantly simplified for the user. Furthermore, it is advantageous that the parts are connected permanently and/or captively to one another, so that the user does not have to ensure that he does not lose a part, such as the sealing cap, and there is no danger of swallowing these parts (small parts below a predetermined minimum size).

The spout has a sleeve-shaped section which has essentially the same diameter as the oblong instrument housing. The movable cap having its transitional reservoir space slides on this section.

The back end of the upper edge of the transitional reservoir seals the spout sleeve in the closed position.

The filling paths are positioned at least partially laterally (directed to the side or radially) as a window in order to reach the transitional reservoir.

An axially directed section of the filling path connects to the main reservoir in the instrument housing.

In this case, "filling" relates both to filling the transitional reservoir and filling the main reservoir, which occur in two periods of time. Therefore, either the lateral or the axial or even both sections of the filling device may be understood as a filling path or filling window.

If a fibrous composite material is provided in the main reservoir, a tapered section of the filling spout may adjoin it directly, and preferably may also be pressed into it somewhat. The quantity of liquid which is pre-dosed after the writing instrument is turned flows here through the tapered section (the front section of the filling spout), directly into the fibrous material in which the colored writing liquid is stored. It is advisable in this case to ventilate by a different path than that through which the liquid flows for filling or refilling. For this purpose, a ventilation opening is provided, which does not lie inside the axial flow path, but rather neighbors it radially. A flow opening, which may be delimited around its circumference, preferably lies in a transition section between the tapered section and the outer end section of the filling spout, which points toward the dosing cap.

An air volume which is displaced by the liquid in the main reservoir—or in the fibrous reservoir material—may thus flow back unimpeded without hindering the liquid from flowing forward. Rapid filling is thus achieved without inks or colored liquids being able to reach the outside.

The movable dosing cap or filling cap having its dosing volume as the transitional reservoir and the writing instrument having its receiving volume as the main reservoir may also be understood in such a way that a transitional reservoir, which is positioned via the dosing cap on the rear end of the writing instrument so it is movable, is held on at least two arms of the dosing cap which are oriented backward. Therefore, the dosing volume may be moved in relation to the writing instrument without it being removed from the writing instrument or having to be removed in order to allow filling through the window formed by the axially extending arms.

During the axial movement, the dosing or filling volume is moved in relation to the main reservoir, i.e., it moves toward or away from it.

EXAMPLE 1

The writing instrument shown in the figures has a sleeve-shaped housing 1, at one end 7 of which a writing tip 2 is inserted to form a seal. Using a closing cap 3, the writing tip may be (sealed) closed by pushing the cap onto a tapered front end 7 of the housing 1.

A reservoir space 6 is located inside the housing 1 as the main reservoir, which may receive a supply of colored writing liquid. Typically, the reservoir 6 is provided with a fibrous filling 6*a* which absorbs the liquid, stores dry or pasty ink concentrate before the first filling, and then also stores liquid writing material when the liquid (e.g., water) is poured in from the outside.

Instead of a dry or pasty ink concentrate, the writing instrument may also contain a writing material in dissolved form (a colored writing material) in the main reservoir 6, 6*a* when it is new from the factory. The reservoir 6*a* filled with fibrous material is filled damp in the manufacturing process in this case, is not dried, and is inserted into the writing instrument in the damp state. Subsequently, the filling device is used as described later. The liquid may be refilled via this filling device at the rear end 8 of the writing instrument sleeve 1, in order to replenish or renew the writing material when it has dried out too much, either through use or being stored too long.

Figure 7:
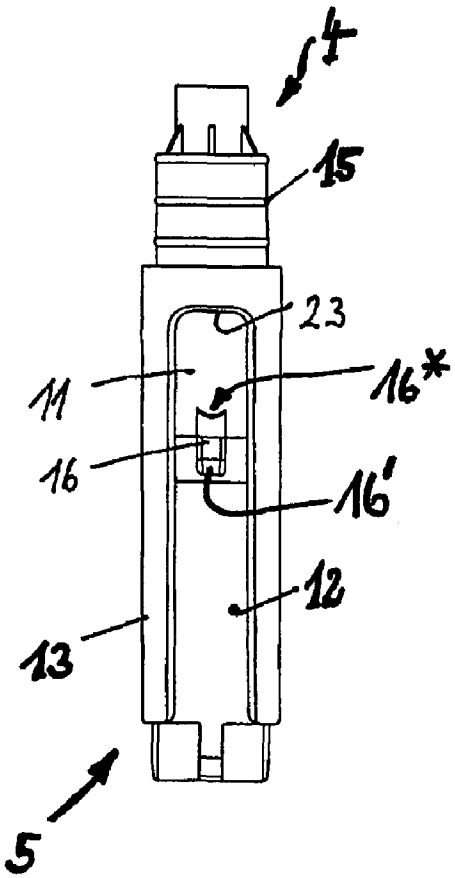
FIG. 5, FIG. 6, and FIG. 7 show the filling device in larger scale than in FIGS. 1 through 4, the filling device being located in the closed position.
Figure 6:
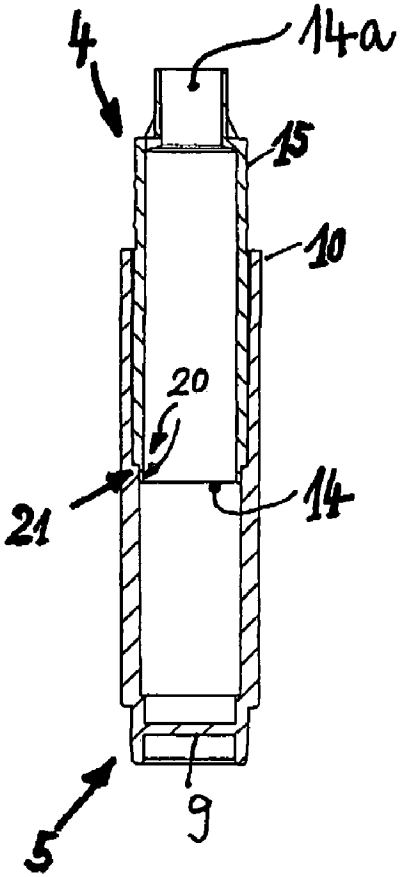
Figure 5:
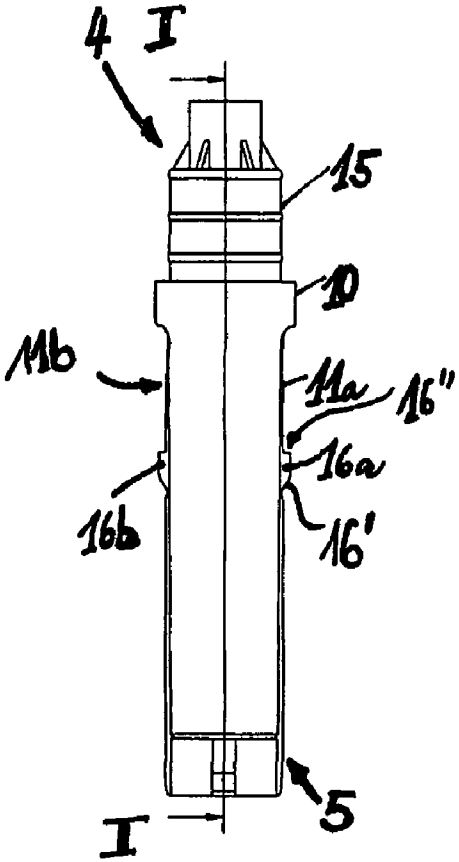

The rear end 8 of the housing 1 is open axially and accommodates a filling spout 4, which is inserted permanently into this end to form a seal, having a plug-in section 15, as shown in FIGS. 5 through 7. The filling spout has two axial sections, a first axial section 4*b* oriented backward and a radially constricted or tapered section 4*a* oriented forward, which is provided with external rings 15 in order to achieve a friction lock, which is also sealed to air and liquids, upon insertion into the rear section 8 of the instrument housing 1, as is obvious from FIGS. 8 and 9.

A dosing cap 5 is positioned on the filling spout so it is displaceable. In the exemplary embodiment shown, the dosing cap 5 is displaceable in the axial direction in relation to the filling spout 4 to a limited degree. It may also be positioned so that the cap 5 is rotatable around the circumference in relation to the filling spout. In each of the two possible embodiments cited, the other theoretically possible relative motion between the two parts may be blocked through appropriate guide elements. A helix may also be implemented in order to achieve the motion of the filling cap in relation to the filling device (having the spout).

Figure 3:
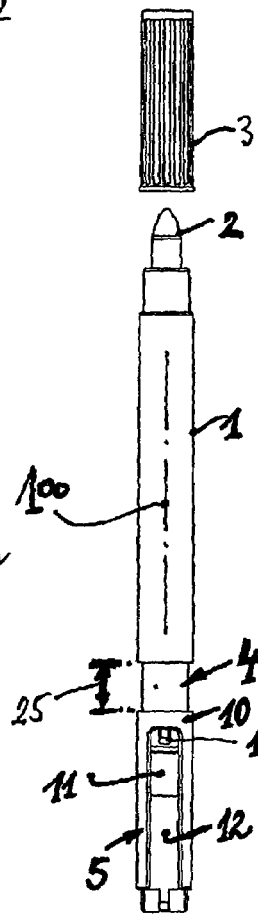
FIG. 3 shows the instrument shown in FIG. 1 in a position rotated around the axis 100 by 90°.

In the example shown, the dosing cap 5 is displaceable in relation to the filling spout 4 only in the axial direction, and only to a limited extent, as is shown in FIG. 3 by the double arrow 25.

The filling spout 4 is axially open at both ends 14, 14*a*. As may be seen best from FIG. 6, the mounting end 15 is implemented as externally profiled in such a way that it may be inserted solidly into the open end 8 of the housing 1 to form a seal.

The filling spout has an open filling opening 14 at the other (rear) end. In this region, the filling spout has an external, shoulder-like profile, as is shown in FIG. 6 at 20. This shoulder-like profile 20, which is peripheral in particular, forms a delimiting stop that determines the closed position of the filling device.

The filling or dosing cap 5 is closed at one end 9. A diametrically opposing section is axially displaceable on the filling spout 4, particularly by sliding.

In FIGS. 5 through 7, the closed position of the filling device is shown. It is obvious from FIG. 6 that the shoulder-like profile section 20 of the filling spout 4 works together in this position with a corresponding internal shoulder section 21 of the dosing cap 5 in that these regions engage with one another to form a seal and delimit the axial motion. In this closed position, a front end 10 of the dosing cap 5 nearly comes the end 8 of the housing 1 into which the filling spout is inserted in the stop position.

On a part of its axial length, the dosing cap has two diametrically opposing, axially running, but laterally (radially) directed filling opening windows 11 *a*, 11 *b* (11 in short). These begin near the end 10 of the cap 5 and end shortly before or at the internal shoulder region 21 shown in FIG. 6. The region of the cap 5 after the internal shoulder 21 shown in FIG. 6 is closed peripherally and up to the end, the wall thickness being reduced in the axial extension 12 of the window 11. Overall, the region between the closed end 9 and the internal shoulder region 21 forms the dosing region 12 of the cap 5 as a transitional reservoir for receiving and dosing the liquid filling quantity 12'.

The filling spout has two lateral catch cams 16*a*, 16*b* (16 in short) in the region of its axial external filling opening 14, which engage in the windows 11 *a*, 11 *b* and thus delimit the open position of the filling device, as is shown in FIGS. 1 through 4. As is obvious from FIGS. 1 through 4, the external filling opening 14 of the filling spout is exposed via the radial windows 11 *a*, 11 *b* in the open position of the filling device. The dosing region 12' of the cap 5 is also freely accessible through the lateral filling openings 11 and therefore may be filled easily with the appropriate quantity of liquid.

The writing instrument is held in this case in the position shown in FIGS. 1 and 3, i.e., vertically, the writing tip pointing upward. If the instrument is held further in this position, after the dosing volume 12 is filled, the cap 5 is pushed upward onto the filling spout 4 until the sealing regions 20 and 21 engage with one another and the lateral filling opening windows 11 are closed. The dosing region of the cap 5 is thus closed, moved toward the main reservoir 6, and freely connected to the reservoir volume 6 of the housing 1 via the inner filling opening

Figure 9:
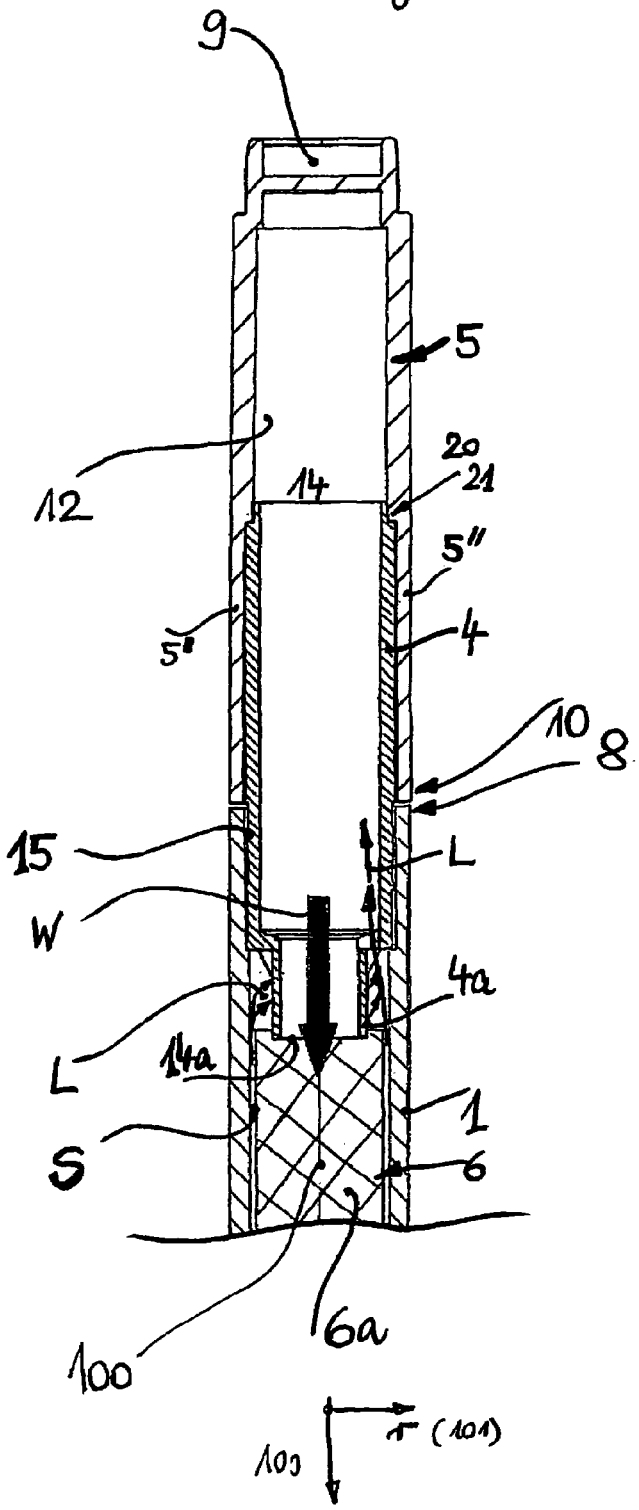
FIG. 9 illustrates the pressure equalization and the flow of liquid along the arrow W and the return flow of air along the arrow L as the liquid flows into the main reservoir 6, 6*a*.

14*a*. When the instrument is now brought into the reversed vertical position, the liquid flows out of the dosing region 12 (transitional reservoir) of the cap 5 into the reservoir region 6 (main reservoir) of the writing instrument and there into the fibrous reservoir 6*a*, as illustrated in FIG. 9.

To delimit the open position, two limiting cams 16 come to rest on the end 23 of the filling opening windows 11, as is shown in FIG. 3.

Figure 4:
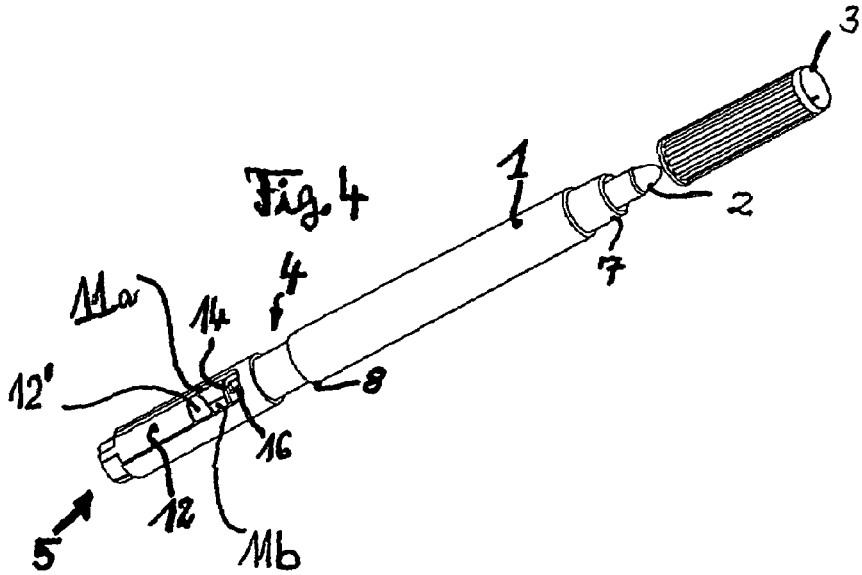
FIG. 4 shows the instrument shown in FIG. 1 in a perspective view, the filling device being located in the filling position.

FIG. 4 allows a free view into the dosing volume 12 in the region of the container-shaped wall section of the dosing cap 5, while the axial (external) filling opening 14 of the filling spout 4 may be recognized through the lateral filling opening window 11 *a*. A part of the diametrically opposing lateral filling opening window 11 *b* is also recognizable in FIG. 4.

A guide and simultaneously a captive coupling between the dosing cap and the filling spout result through the engagement of the cam-like catches 16 in the filling opening windows 11.

The cam-like catches 16 are the catch cams 16*a* and 16*b* if two windows 11 a, 11 *b* are used. Each of these cams has two unequal axial end sections. One of them is implemented as a slanted ramp 16', and the other as a catch point 16". The first is used for the purpose of allowing the front end 10 of the writing cap 5 to engage with a certain elasticity over the slanted ramps and the cams after it is manufactured, so that they come to rest in the windows 11*a*, 11*b*. The steeper catch point 16" is used for the purpose of achieving the catch in the extended position (the open position) at the front edge 23 of the window. This front edge 16" may also be implemented as may be seen in more detail from FIG. 7. A bulge 16* may be seen here, whose pointed end stops at the edge 23 when the filling position of the writing cap 5 is reached.

The filling device, as is shown per se in FIGS. 5 and 7, may easily be inserted solidly to form a seal into the open end 8 of the housing 1 of an instrument as a pre-manufactured unit.

The operation is extraordinarily simple, only the position of the instrument during filling and up to being pushed onto the dosing cap to form a seal having to be ensured.

Figure 8:
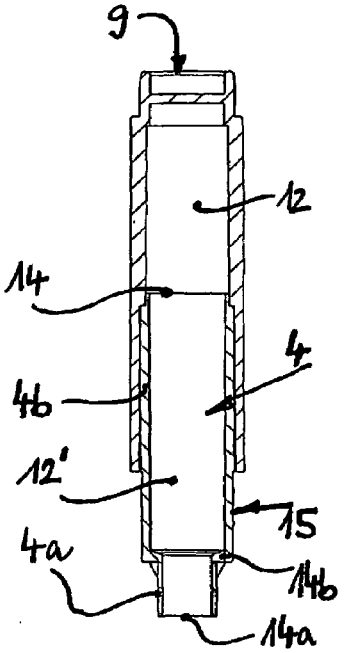
FIG. 8 is a reversed illustration of FIG. 6, illustrating a second flow opening 14*b*, using which pressure is equalized during filling.

The function of the filling, i.e., the flowing of the temporarily stored liquid in the dosing volume 12 over to the main reservoir 6 may be described on the basis of FIGS. 8 and 9.

FIG. 8 is an inverted illustration of FIG. 6, the transitional region between the tapered front section 4*a* and the section 4*b* of the filling spout 4 lying behind it being illustrated. In a radial step having approximately triangular ribs for stiffening, a flow opening 14*b* is provided, which opens an axial flow path offering stored air the ability to flow back out of the front reservoir 6 between the tapered section 4*a* and the radially larger section 4*b*.

This back flow of the air occurs when the liquid stored in the dosing volume 12 reaches the filling spout 4 in the illustration of FIG. 3, where it is symbolically indicated as 12'. From here, it flows via the axial flow section 14*a* pointing toward the reservoir 6 into the section 4*a*, while simultaneously, without hindering this liquid flow W described, air L may escape out of the reservoir 6 through the adjoining back flow opening 14*b*.

Excess pressure in the reservoir and partial vacuum in the filling cap are avoided, so that rapid filling and equalization of air and liquid may be achieved. In addition, inks or colored liquid are prevented from being able to escape from the instrument.

FIG. 9 illustrates the assembled state of the writing instrument with a section of the main reservoir 6 having a fibrous reservoir body 6*a* inserted therein, which has a radial dimension somewhat smaller than the internal dimension of the sleeve-shaped writing instrument body 1. This peripheral gap is identified with S. Air flows axially upward out of this gap along the flow path L (after the writing instrument is turned out of the position of FIG. 3), when the dosed liquid flows along the flow path W through the front section 4*a* of the filling spout 4 into the reservoir body 6*a*. The pressure equalization occurs via the flow opening 14*b*, which was explained with reference to FIG. 8.

The closed state of the dosing cap 5, in which the shoulder-like sealing sections at the axially external end 14 and on the internal region of the dosing cap 5 engage in one another to form a seal, is shown in FIG. 9. The dosing volume 12 which was explained in FIG. 4 lies above this sealing section.

In another way of viewing them, FIG. 9 and FIG. 4 may also be described so that a dosing volume or a filling volume is held on at least two arms 5' and 5" at a distance from the rear section 8 of the instrument housing 1.

If the dosing cap 5 is displaced or moved peripherally as a whole, as described previously with reference to a rotational motion or a helical motion, the dosing volume 12 on the arms 5' and 5" moves away from the main reservoir 6 in order to be filled. After the filling and transitional storage, it may be moved toward the instrument housing again via the arms, the windows 11 *a*, 11 *b* remaining between the arms being closed when the sealing regions 20, 21 described previously engage with one another (particularly catch or lock).

What is claimed is:

1. Filling device for a writing instrument having a storage reservoir in a housing for a refilling liquid, wherein a wick-like portion of a writing tip exposed on one end of the housing projects into the storage reservoir, wherein a filling spout for the liquid is attachable to the other end of the housing and a dosing cap is provided on the filling spout, the dosing cap being movable to an end position while remaining on the filling spout, to expose at least one filling opening for supplying the liquid prior to reaching said end position of the dosing cap.

2. Filling device for a writing instrument—refillable with a liquid—having a main reservoir arranged in a housing, wherein a wick-like portion of a writing tip exposed on one end of the housing projects into the reservoir wherein the filling device has at least one radially directed opening for filling the liquid and a cap is provided which is axially displaceable between position which exposes the filling opening and position which closes the filling opening.

3. Filling device according to claims 1 or 2, wherein the filling spout is insertable into the end of the housing to form a seal via an essentially cylindrical portion.

4. Filling spout for a filling device according to claim 1 or 2, wherein a dosing cap is arranged on the filling spout to be movable, particularly axially displaceable, but is arranged captive.

5. Filling device according to claims 1 or 2, wherein the cap is implemented in a sleeve shape as a dosing cap and is closed for liquid at one free end, and particularly has two essentially diametrically opposing radial filling opening windows which have only a limited axial extension.

6. Filling device according to claim 5, wherein the lateral filling opening windows are dimensioned in regard to an open axial filling end of the filling spout and an axial opening path of the filling cap in such a way that they expose the filling end of the filling spout at latest in the filling position, preferably earlier.

7. Filling device according to claims 1 or 2, wherein the filling spout has a catch cam—engaging in at least one lateral window of the dosing cap—which determines the filling position, at the end section of the housing near its filling end.

8. Filling device according to claims 1 or 2, wherein the filling spout has a shoulder-like sealing section on its external filling end which contacts a corresponding internal shoulder region of the dosing cap—determining the closed position—to form a seal when the dosing cap is closed.

9. Filling device according to claims 1 or 2, wherein the dosing cap is axially movable, particularly displaceable, between two end positions on the spout.

10. Filling device according to claims 1 or 2, wherein the filling opening is composed of a radial section and an axial section for the extension into the reservoir.

11. Filling device according to claims 1 or 2, wherein an axially extending container section for transitional storage of a dosing volume of the liquid is provided between the window and an end section of the cap.

12. Filling device according to claim 8, wherein a transitional reservoir to accommodate a dosing volume is located between the sealing section and a free end of the dosing cap.

13. Filling device according to claims 1 or 2, wherein a ventilation opening is provided next to at least one axial section of the filling opening for air (L) to flow back as liquid (W) flows forward.

14. Filling device according to claim 1, wherein the filling spout has a first section pointing toward the main reservoir, which is tapered in relation to a second section pointing toward the dosing cap, in particular has a reduced diameter or is stepped.

15. Filling device according to claim 14, wherein an opening, which extends to a limited extent around the circumference, is provided in a transitional section between the tapered section and the second section for pressure equalization during filling.

16. Method for filling a writing instrument having an internal reservoir space in a housing, for accommodating and storing a writing material, which, by supplying a liquid and dissolving pigments stored in the reservoir space, is produced or is supplemented, replenished, or completed and is stored in the reservoir space, wherein (i) a cap is guided movably on the instrument housing;

(ii) the cap is moved from a closed position and exposes at least one window during the movement before reaching a filling position, the cap still being held on the writing instrument in the filling position;

(iii) to allow a partial volume of liquid to be filled into a receiving portion of the cap through the at least one window and be temporarily stored;

(iv) to close the at least one window by moving the cap back into the closed position;

to prepare for essentially complete accommodation of the partial volume from the transitional storage into the internal reservoir space after the writing instrument is pivoted.

17. Method according to claim 16, wherein, before the complete closing by reaching the closed position or as the cap is moved back into the closed position, the temporarily-stored partial volume in the receiving section is brought closer to the internal reservoir space.

18. Method according to claim 16, wherein the window has at least one lateral section and one axial section, and the liquid is poured into the transitional reservoir through the at least one lateral window section and is transferred from the transitional reservoir into the internal reservoir space through the axial window section.

19. Method according to claim 18, wherein, as the liquid is transferred (W) from the transitional reservoir into the main reservoir, air (L) flows back from the main reservoir through a separate flow path for pressure equalization.

* * * * *